United States Patent [19]

Siskin

[11] Patent Number: 4,490,238

[45] Date of Patent: Dec. 25, 1984

[54] PROCESS FOR BENEFICIATING OIL-SHALE

[75] Inventor: Michael Siskin, Livingston, N.J.

[73] Assignee: Exxon Research and Engineering Co., Florham Park, N.J.

[21] Appl. No.: 600,433

[22] Filed: Apr. 16, 1984

[51] Int. Cl.[3] ..... C10G 1/04

[52] U.S. Cl. ..... 208/11 LE; 423/114; 423/131; 423/157; 423/658.5

[58] Field of Search ..... 208/8 LE, 11 LE, 81 R; 423/114, 119, 131, 130, 157, 658.5

[56] References Cited

U.S. PATENT DOCUMENTS

| | | | |
|---|---|---|---|
| 3,503,705 | 3/1970 | Tackett | 423/119 |
| 3,516,787 | 6/1970 | Van Nordstrand | 423/119 |
| 3,642,433 | 2/1972 | Dyni | 423/119 |
| 3,721,730 | 3/1973 | Haei | 423/119 |
| 3,821,353 | 6/1974 | Weichman | 423/119 |
| 3,859,413 | 1/1975 | Haas | 423/119 |
| 3,962,403 | 6/1976 | Wyslouzil | 423/206 R |
| 4,176,042 | 11/1979 | Fahlström | 423/658.5 |
| 4,250,016 | 2/1981 | Estes et al. | 208/11 LE |
| 4,342,729 | 8/1982 | Garcia et al. | 423/131 |
| 4,408,999 | 10/1983 | Nadkarni et al. | 208/11 LE |

*Primary Examiner*—Delbert E. Gantz
*Assistant Examiner*—A. Pal
*Attorney, Agent, or Firm*—Henry E. Naylor

[57] ABSTRACT

Disclosed is a process for beneficiating oil-shale wherein the oil-shale is treated with an aqueous ammonium salt solution at a temperature from about 0° C. to about 300° C.

6 Claims, No Drawings

PROCESS FOR BENEFICIATING OIL-SHALE

BACKGROUND OF THE INVENTION

The present invention relates to the beneficiation of oil-shale by treating the oil-shale with an ammonium salt solution at a temperature from about 0° C. to about 300° C. for a time sufficient to remove carbonate minerals from the oil-shale.

Oil-shale, a sedimentary rock found in vast formations in several parts of the world, contains about 5 to about 60 wt.% organic material. About 10% of this organic material is extractable with organic solvents and is called bitumen. The remainder of the organic material is insoluble in organic and inorganic solvents and is a crosslinked macromolecular material called kerogen. The remainder of the oil-shale is inorganic and is composed of various minerals including clays. Much work has recently been done to develop efficient methods for acquiring useful liquids and gases from oil-shale as replacements for petroleum liquids. The inherent mineral matter in oil-shale represents significant debits in both the handling and processing of the resource. Typically, the organic material which can be converted to useful fuels and chemical feedstocks, preferably liquids, represents only about 10–25 wt.% of the oil-shale. Furthermore, during processing there is considerable increased abrasive wear on preparation and conversion plants owing to the nature of mineral matter. Also, relatively large reactor sizes are required to accomodate the higher material throughputs necessitated by the large quantities of mineral matter. Most important, large quantities of rock needs to be heated to high temperatures in order to break-down the kerogen of the oil-shale to liquid and gaseous products. This represents a loss in energy efficiency since much of this heat is not recoverable as useful work. In processes which include a catalyst during processing, there is a significant potential that the minerals inherently present in the oil-shale will contribute to catalyst poisoning. Consequently, various processes have been devised over the years to beneficiate, or demineralize oil-shale prior to further processing to concentrate the organic material and to alleviate the above-mentioned problems associated with oil-shale processing.

Although both physical and chemical methods have been developed for separating organic material from oil-shale thereby leaving substantially all of the mineral matter behind, chemical methods usually are superior over physical methods because of better separations obtained. One common type of chemical method for the separation of kerogen from oil-shale is acid dissolution of the inorganics. Such technique typically involves the digestion of oil-shale with hydrochloric acid, hydrofluoric acid, or both. The hydrochloric acid dissolves the carbonate minerals and the hydrofluoric acid dissolves the silicate and clay minerals, thereby leaving a kerogen material containing about 5 to 10 wt.% minerals. Although such schemes have met with varying degrees of success, they suffer the disadvantage of being corrosive and, in most cases the inability to regenerate the acid reagents economically for recycle makes the process unattractive.

A variation in this acid technique is disclosed by R. D. Thomas in Fuel, 48, 75–80 (1969) wherein all of the mineral carbonates are removed from Green River oil-shale by treatment with carbonic acid. Thomas claims that after sodium hydroxide washing to remove fine clay-like particles, the carbonate-free material can be centrifuged in a saturated aqueous calcium chloride solution to yield a concentrate containing 85–90 wt.% of the original kerogen with an ash content of less than 30 wt.%. Attempts to reproduce the physical separation results after demineralization with carbonic acid have been unsuccessful. See Vendergrift, G. F., Winans, R. E., and Horowitz, E. P., Fuel, 59, 634–6 (1980).

A variation of using acids to enrich the kerogen content of oil-shales which are rich in carbonates involves leaching by use of a sulfuric acid medium generated by the oxidizing capabilities of specific bacteria which convert pyrite in the oil-shale to sulfuric acid. The sulfuric acid produced decomposes the carbonate minerals in the oil-shale leaving a kerogen enriched material containing significant amounts of silica. See U.S. Pat. No. 4,043,884.

Other approaches to chemical beneficiation include extraction of low grade Western U.S. oil-shales with aliphatic amides to recover 69 wt.% to 83 wt.% of the organics (U.S. Pat. No. 4,357,230), and treatment of various oil-shales with a 1:1 mixture of trichloroisocyanuric acid and a chlorine donor such as calcium hypochlorite in the presence of a petroleum based naphtha solvent giving recoveries of organics up to about 98 wt.% (U.K. Pat. No. 2,090,858).

Furthermore, disclosed in Intl. Patent Appl. Wo 82/03404 is a two-step treatment of oil-shale with 16 parts of fused alkali metal caustic at 350° C. for 40 minutes followed by a sulfuric acid wash which led to recovery of 86 wt.% of the organics. This type of treatment suffers from the disadvantage that it may have a detrimental effect on the kerogen structure and reactivity.

Although various methods have been used, including physical grinding combined with chemical treatment, for beneficiating oil-shale, such prior art methods have not been able to remove a significant amount of mineral matter from the organic material under relatively mild conditions without the reagent being simultaneously and irreversibly destroyed. Consequently, there is still a need in the art for processes which are able to beneficiate oil-shale under relatively mild conditions and leave the beneficiation reagent in a form which is easily regenerable. Furthermore, none of the prior art methods suggest the use of ammonium salts for beneficiating oil-shales.

SUMMARY OF THE INVENTION

In accordance with the present invention there is disclosed a process for removing mineral matter from oil-shale which process comprises contacting the oil-shale with an ammonium salt solution at a temperature from about 0° C. to about 300° C. for a time sufficient to substantially separate at least about 80% of the carbonate mineral matter from the oil-shale.

In preferred embodiments of the present invention, the oil-shale is contacted at a temperature from about 60° C. to about 250° C. and the ammonium salt is selected from the group consisting of ammonium carbonate, ammonium bicarbonate, ammonium acetate, ammonium nitrate, ammonium phosphates, and ammonium sulfate.

DETAILED DESCRIPTION OF THE INVENTION

The general composition and characteristics of oil-shale are well known (See "Kerogen" edited by B. Durand, Editors Technip, Paris 1980) and will therefore not be described in detail herein. For practical purposes, the oil-shale should contain at least about 5, preferably at least about 10, and more preferably at least about 20% by weight of organic material, based on the total weight of the oil-shale. Such oil-shales usually contain at least about 7.5, preferably at least about 15, and more preferably between about 25 and 75 gallons of oil per ton of oil-shale, by Fischer Assay.

Although the present invention can be practiced on any type of oil-shale, it is more advantageous to employ an oil shale having high carbonate and clay mineral matter compositions.

Although the particle size of the oil-shale is not critical, it is preferred for convenience of handling that the oil-shale be crushed to a particle size having an average diameter of less than about 1 inch, preferably less than about ½ inch. The diameter of the particles as referred to herein is the smallest size of the screen opening through which particles of the designated "diameter" will pass.

Ammonium salts suitable for use in the instant invention are ammonium salts of organic and inorganic acids. Preferred are the ammonium salts of strong mineral acids. Nonlimiting examples of such ammonium salts suitable for use herein include ammonium carbonate, ammonium bicarbonate, ammonium acetate, ammonium nitrate, ammonium sulfate, and ammonium phosphates. Preferred are ammonium nitrate and ammonium sulfate, more preferred is ammonium sulfate.

The temperatures at which the instant process is carried out will generally be at temperatures from about 0° C. to about 100° C. when atmospheric pressure is employed. If higher pressures are employed the temperature can be as high as about 300° C. If salts such as ammonium carbonate and bicarbonate are used, which decompose at temperatures greater than about 50° C., elevated pressures must be used to keep the components of the salts in solution and care must be taken to maintain a low partial pressure of $CO_2$ in order to facilitate the decomposition reaction of carbonate minerals.

In the practice of the present invention, oil-shale is contacted with the aqueous ammonium salt solution for an effective amount of time in an appropriate reactor at an effective temperature; that is, for a time sufficient to remove a desired amount of carbonate minerals from the oil-shale. It will be appreciated that the specific amount of time and temperature will be dependent on such things as temperature, specific ammonium salt, the amount of ammonium salt, pressure, and size of the oil-shale employed. By way of example, a one molar aqueous solution of ammonium sulfate will remove at least about 80 wt.% of the carbonate mineral matter from 80–100 mesh particles of Green River oil-shale which contains about 20.6 wt.% organic material and about 40 wt.% carbonate minerals when the oil-shale is contacted with a 1M ammonium sulfate solution for 2 days at a temperature of 100° C.

After the predetermined amount of mineral matter has been removed from the oil-shale, the result is a two phase system. That is, there will be an upper aqueous phase and a lower solids phase. Carbon dioxide and ammonia gas which evolves during the decomposition of minerals can be recovered and used in the regeneration of the ammonium salt. The resulting solid phase, which is the beneficiated oil-shale, is higher in organic content than the starting oil-shale, i.e., about 35 wt.%, and can be passed along for further processing. The upper aqueous phase will contain dissolved mineral salts derived from the carbonate minerals of the oil-shale, which phase can be easily separated from the beneficiated product.

The ammonium salt solution should be present in at least a stoichiometric amount based on the amount of carbonate minerals present in the starting oil-shale. Generally, a 1 to 4 molar solution of the ammonium salt is adequate.

The following examples serve to more fully describe the manner of practicing the above-described invention as well as to set forth the best modes contemplated for carrying out various aspects of the invention. It is to be understood that these examples in no way serve to limit the true scope of this invention, but rather, are presented for illustrative purposes.

EXAMPLES

Samples of Green River oil-shale (3g) containing 20.6 wt% organic material and about 40 wt.% carbonate minerals and having an 80–100 mesh particle size, was charged into a reactor containing a magnetic stir bar. A 1M solution (30 mL) of an ammonium salt was then charged into the reactor and the mixture was heated to various temperatures with stirring for the number of days indicated in Table I below under a nitrogen atmosphere. The reaction mixture was then cooled to room temperature (20° C.) and filtered through a Teflon filter paper lined Buchner funnel. The resulting beneficiated oil-shale was then dried in a vacuum oven at 100° C. overnight and analyzed for weight loss. Elemental analysis of the samples showed that the weight loss for each was due to decomposition of calcium and magnesium carbonate minerals. Table I below contains the data for each salt, temperature, and time combination used.

TABLE I

| $NH_4$ Salt (1M) | T (°C.) | t (days) | Wt. Loss (Wt. %) |
|---|---|---|---|
| Carbonate | 20 | 5 | 2.9 |
| | 20 | 5 | 2.2 |
| | 40 | 5 | 2.2 |
| | 40[1] | 5 | 13.9 |
| Bicarbonate | 20 | 5 | 3.4 |
| | 40 | 5 | 1.9 |
| | 40[1] | 5 | 26.7 |
| Acetate | 20 | 3 | 7.6 |
| | 40 | 3 | 8.0 |
| | 100 | 2 | 38.6 |
| Nitrate | 20 | 3 | 7.3 |
| | 40 | 3 | 7.2 |
| | 100 | 2 | 38.6 |
| Sulfate | 20 | 3 | 9.2 |
| | 40 | 3 | 10.0 |
| | 100 | 2 | 39.5 |

[1]Closed system.

What is claimed is:

1. A process for removing mineral matter from oil-shale which process comprises contacting the oil-shale with an ammonium salt solution at a temperature from about 0° C. to about 300° C. for at least a period of time which is sufficient to remove at least about 80 wt.% of the carbonate mineral matter from the oil-shale.

2. The process of claim 1 wherein the temperature is from about 0° C. to about 100° C. and atmospheric pressure is used.

3. The process of claim 1 wherein the ammonium salt solution contains one or more salts selected from the group consisting of ammonium carbonate, ammonium bicarbonate, ammonium acetate, ammonium nitrate, ammonium sulfate, and ammonium phosphates.

4. The process of claim 3 wherein the ammonium salt solution contains one or more of ammonium nitrate and ammonium sulfate.

5. The process of claim 2 wherein the ammonium salt solution contains one or more salts selected from the group consisting of ammonium carbonate, ammonium bicarbonate, ammonium acetate, ammonium sulfate, and an ammonium phosphate.

6. The process of claim 5 wherein the ammonium salt solution contains one or more of ammonium nitrate and ammonium sulfate.

* * * * *